US009219329B2

(12) United States Patent
Murphy et al.

(10) Patent No.: US 9,219,329 B2
(45) Date of Patent: Dec. 22, 2015

(54) HARSH DUTY RECEPTACLE CONNECTOR

(75) Inventors: Joseph F. Murphy, Highland Park, IL (US); Randall G. Stone, McHenry, IL (US)

(73) Assignee: Woodhead Industries, Inc., Lincolnshire, IL (US)

( * ) Notice: Subject to any disclaimer, the term of this patent is extended or adjusted under 35 U.S.C. 154(b) by 77 days.

(21) Appl. No.: 14/131,121

(22) PCT Filed: Jul. 7, 2011

(86) PCT No.: PCT/US2011/043174

§ 371 (c)(1),
(2), (4) Date: Apr. 8, 2014

(87) PCT Pub. No.: WO2013/006179

PCT Pub. Date: Jan. 10, 2013

(65) Prior Publication Data

US 2014/0342593 A1 Nov. 20, 2014

(51) Int. Cl.
*H01R 13/52* (2006.01)
*H01R 13/58* (2006.01)
(Continued)

(52) U.S. Cl.
CPC ..... *H01R 13/5825* (2013.01); *H01R 13/53* (2013.01); *H01R 13/567* (2013.01); *H01R 13/582* (2013.01); *H01R 13/622* (2013.01); *H01R 13/533* (2013.01); *H01R 13/746* (2013.01)

(58) Field of Classification Search
CPC .. H01R 13/5825; H01R 13/622; H01R 13/53; H01R 13/567; H01R 13/582; H01R 13/533; H01R 13/746; H01R 13/58; H01R 13/521; H01R 13/523
USPC ..... 439/276, 271, 272, 274, 275, 452, 359
See application file for complete search history.

(56) References Cited

U.S. PATENT DOCUMENTS 3,129,993 A 4/1964 Ross
4,693,534 A 9/1987 Clark
(Continued)

FOREIGN PATENT DOCUMENTS

DE 10 20 395 B 12/1957
DE 39 40 230 A1 6/1991
(Continued)

OTHER PUBLICATIONS

International Search Report for PCT/US2011/043174, Feb. 9, 2012.

*Primary Examiner* — Javaid Nasri
(74) *Attorney, Agent, or Firm* — Clarence R. Moon, III

(57) ABSTRACT

A sealed electrical receptacle connector, either male or female, includes, in combination, a bushing and a shell threadably coupled together in an end-to-end manner. The bushing is adapted to receive a cable having plural conductors arranged in a spaced manner and separated from another along their respective lengths by an elongated nonconductive insert having plural radially extending spaced members, each disposed between a pair of adjacent conductors. A split washer is disposed between and in abutting contact with adjacent inner end portions of the receptacle and the shell and includes a slot extending therethrough. The split washer facilitates receptacle connector assembly and its slot is adapted to receive the plural conductors and an elongated axial strength member, such as a multi-strand steel cable, disposed within and along the length of the nonconductive insert to provide the receptacle connector and cable combination with high strength.

20 Claims, 6 Drawing Sheets

(51) Int. Cl.

| | |
|---|---|
| ***H01R 13/56*** | (2006.01) |
| ***H01R 13/53*** | (2006.01) |
| ***H01R 13/622*** | (2006.01) |
| *H01R 13/533* | (2006.01) |
| *H01R 13/74* | (2006.01) |

(56) References Cited

U.S. PATENT DOCUMENTS

| | | | | |
|---|---|---|---|---|
| 5,224,187 | A | 6/1993 | Davisdon | |
| 5,993,266 | A | 11/1999 | Mayer et al. | |
| 6,116,955 | A | 9/2000 | Lazaro, Jr. | |
| 6,844,498 | B2 | 1/2005 | Hall et al. | |
| 7,726,997 | B2 * | 6/2010 | Kennedy et al. | 439/274 |
| 2005/0013573 | A1 | 1/2005 | Lochkovic et al. | |
| 2006/0057885 | A1 | 3/2006 | Brodin | |
| 2010/0329627 | A1 | 12/2010 | Donaldson | |
| 2012/0164870 | A1 | 6/2012 | Murphy et al. | |

FOREIGN PATENT DOCUMENTS

| | | | |
|---|---|---|---|
| EP | 2 202 852 | A2 | 6/2010 |
| JP | 58-95512 | | 6/1983 |
| JP | 62-241278 | A | 10/1987 |
| JP | 04-040482 | | 4/1992 |
| JP | 04-306574 | A | 10/1992 |
| JP | 2001-332339 | A | 11/2001 |
| JP | 2005-050555 | A | 2/2005 |

* cited by examiner

HARSH DUTY RECEPTACLE CONNECTOR

FIELD OF THE INVENTION

This invention relates generally to electrical receptacle connectors, and is particularly directed to an electrical receptacle connector having an internal structural member disposed within an electrical cable coupled to the connector for providing the cable and connector combination with great strength.

BACKGROUND OF THE INVENTION

An electrical receptacle connector is a fitting connected to an electrical cable and adapted to receive a plug. The cable may carry electric power or may include one or more conductors carrying electrical signals. Sometimes the receptacle connector is attached to an electrical panel member. When employed in a harsh environment, large forces may be applied to the receptacle connector which may result in loosening or separation of the cable from the receptacle connector and loss of power or electrical signals. To deal with these large forces, some connectors are provided with high strength materials. One form that these high strength materials take is known as Kevlar. Kevlar as a para-aramid synthetic fiber having high strength. Kevlar is typically spun into ropes or fabric sheets, or it may be used as an ingredient in composite material components. Kevlar exhibits a high tensile strength-to-weight ratio and is said to be five times stronger than steel on an equal weight basis. However, on a space, or volume, basis, a substantially greater amount of Kevlar is required to provide the same strength as steel. Thus, where space is at a premium, such as in the area of electrical connectors and components, Kevlar's applications are somewhat limited. In addition, because Kevlar typically is comprised of a large number of individual strands of different lengths, the cumulative effect of all of the strands is not realized along the entire length of an elongated Kevlar member such as an electrical cable and connector assembly and the strength exhibited by Kevlar in this environment is limited. In addition, Kevlar strands are typically secured to another member by tying which is impractical in the small dimension environment of electrical connectors.

The present invention is intended to provide a high strength electrical receptacle connector capable of operating in harsh duty environments where tension values as high as 300 pounds may be encountered.

SUMMARY OF THE INVENTION

Accordingly, it is an object of the present invention to provide a high strength, compact electrical receptacle connector which is easily connected in a sealed manner and disconnected and may be either female or male in configuration.

It is another object of the present invention to provide an electrical receptacle connector adapted for use with multiple conductors in a single shielded cable which includes an elongated nonconductive insert for maintaining the conductors in fixed, spaced relation and for providing physical and electrical isolation between adjacent conductors within the receptacle connector.

A further object of the present invention is to provide a split washer in an electrical receptacle connector which is securely coupled to a high strength steel cable to provide the receptacle connector with high strength and which allows the receptacle connector to be easily assembled.

A still further object of the present invention is to provide an electrical receptacle connector comprised of an end-to-end threadably coupled bushing and shell combination and which is connected to a cable having plural conductors and a steel cable to provide high strength, wherein tightening of the threadably coupled bushing and shell places the steel cable under increased tension while simultaneously introducing slack in the electrical conductors.

The present invention contemplates an electrical receptacle connector adapted to receive an electrical cable having plural conductors, the electrical receptacle connector comprising: a bushing adapted to receive the electrical cable and having a first threaded end portion; a shell adapted to receive the electrical cable and having a second threaded end portion coupled to the first threaded end portion of the bushing; an elongated, thin strength member disposed in and extending along a portion of the length of the electrical cable; and a split washer connected to the strength member and having an open inner portion and a partially circular peripheral portion, wherein the plural conductors are disposed in and extend through the open inner portion of the split washer and the partially circular peripheral portion of the split washer is disposed in contact with the first threaded end portion of the bushing, and wherein tightening of the coupling between the bushing's first threaded end portion and the shell's second threaded end portion urges the split washer into tight fitting engagement with the shell applying increased tension upon the strength member while removing tension from the plural conductors.

The present invention further contemplates a multi-conductor electrical cable and receptacle connector arrangement comprising: a bushing adapted to receive the electrical cable and having a first threaded end portion; a shell adapted to receive the electrical cable and having a second threaded end portion coupled to the first threaded end portion of the bushing; an elongated, thin strength member disposed in and extending along a portion of the length of the electrical cable; a retaining member having an open inner portion and a partially circular peripheral portion, wherein the plural conductors and the strength member are disposed in and extend through the open inner portion of the retaining member and the partially circular peripheral portion of the retaining member is disposed in contact with the first threaded end portion of the bushing for increasing the strength of the electrical cable receptacle and connector arrangement; and an elongated centering and isolating member disposed within and along at least a portion of the length of the cable, wherein the centering and isolating member is disposed about the strength member and intermediate adjacent conductors for centering the strength member within the cable and isolating the conductors from the strength member while maintaining the conductors in equally spaced relation from one another.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
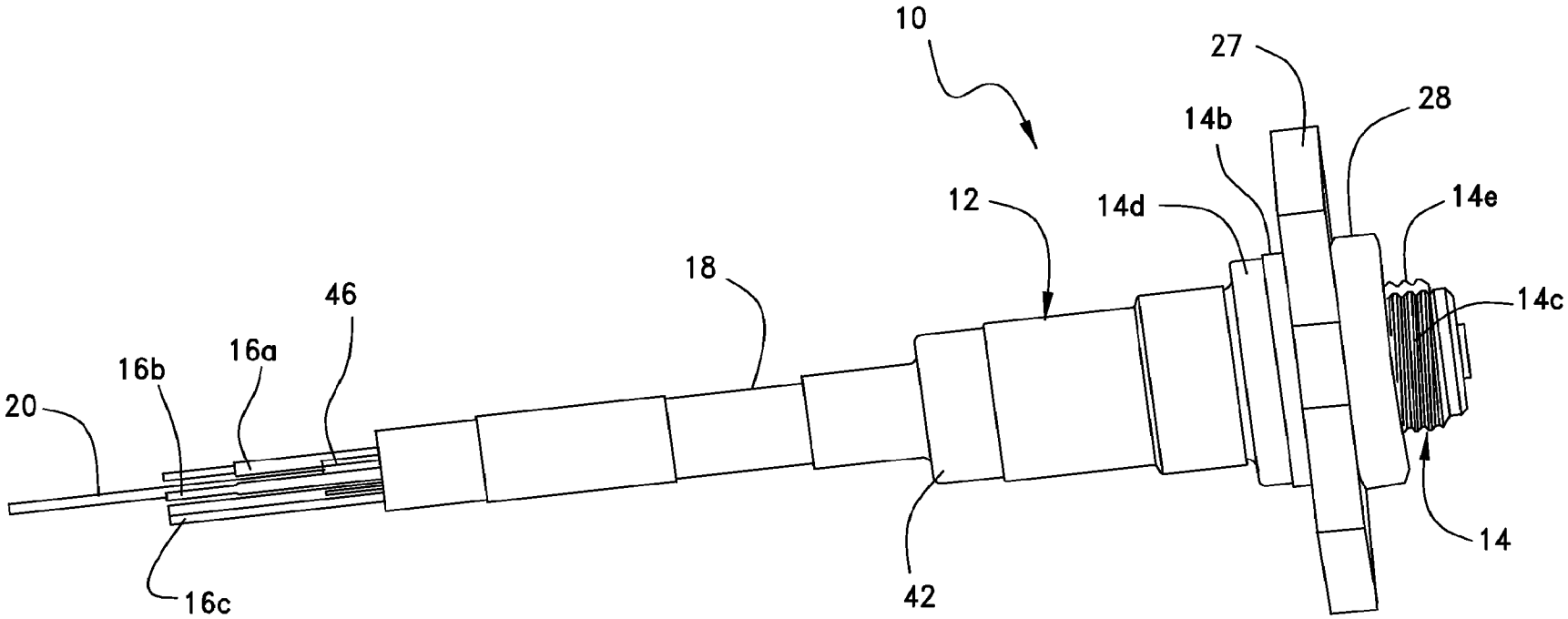
FIG. 1 is a side elevation view of a harsh duty receptacle connector in accordance with the principles of the present invention.
Figure 2:
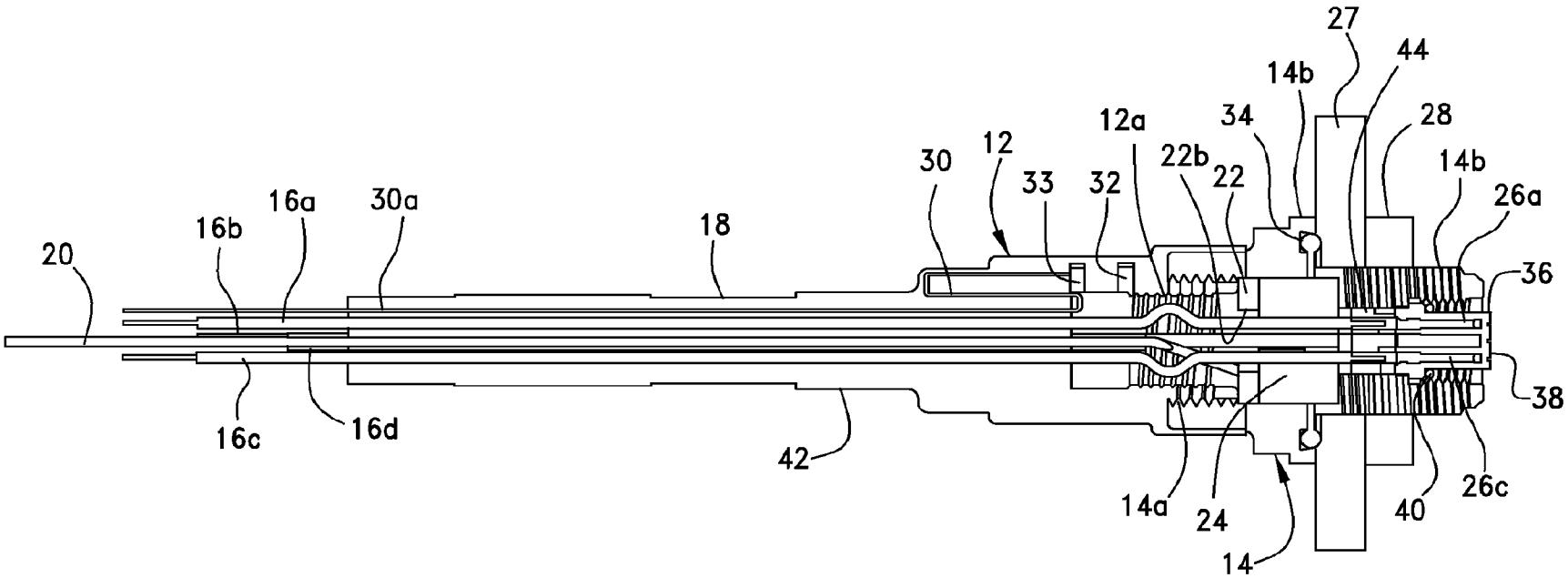
FIG. 2 is a longitudinal sectional view of the inventive harsh duty receptacle connector.
Figure 3:
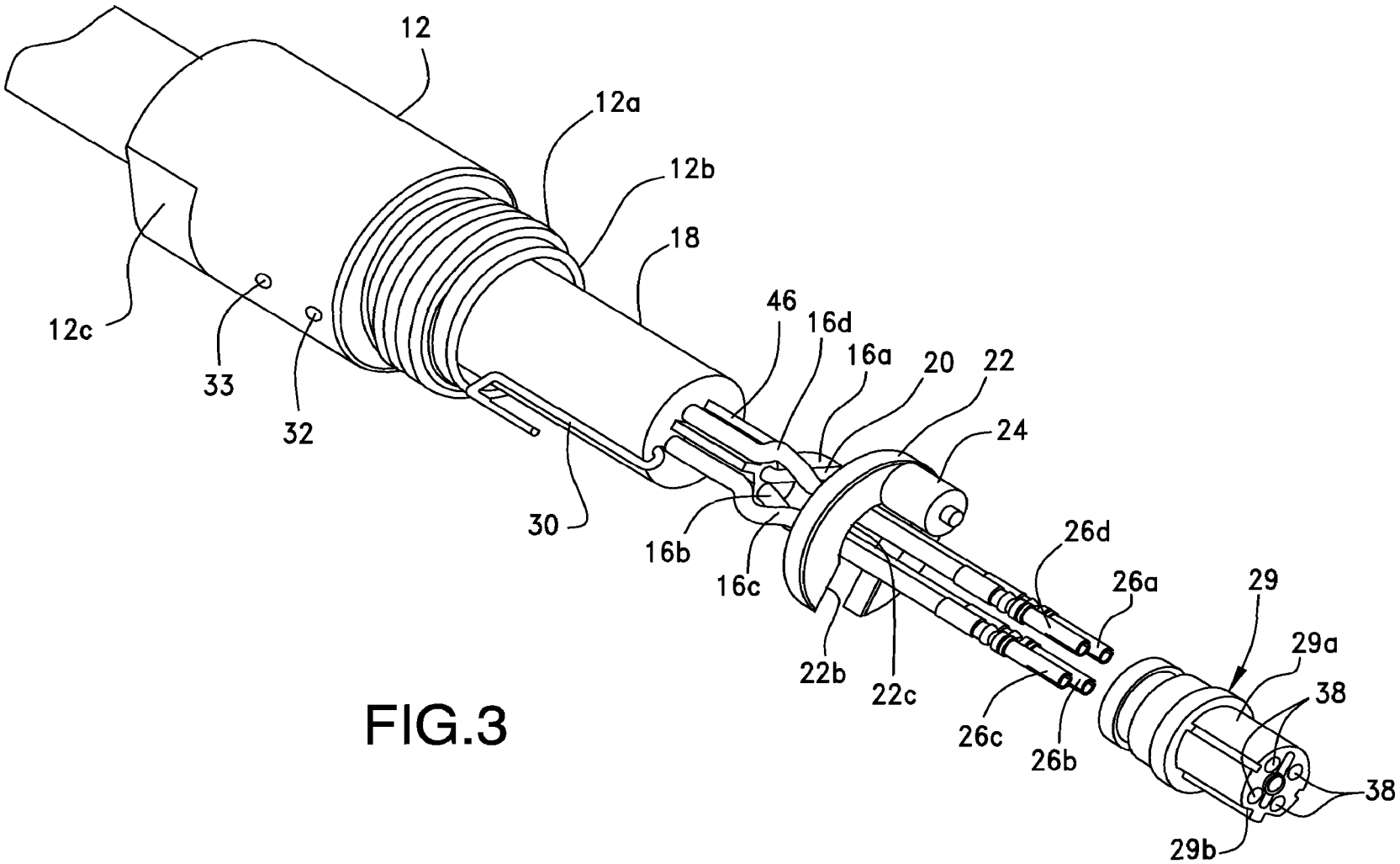
FIG. 3 is an exploded perspective view of a portion of the inventive harsh duty receptacle connector.
Figure 4:
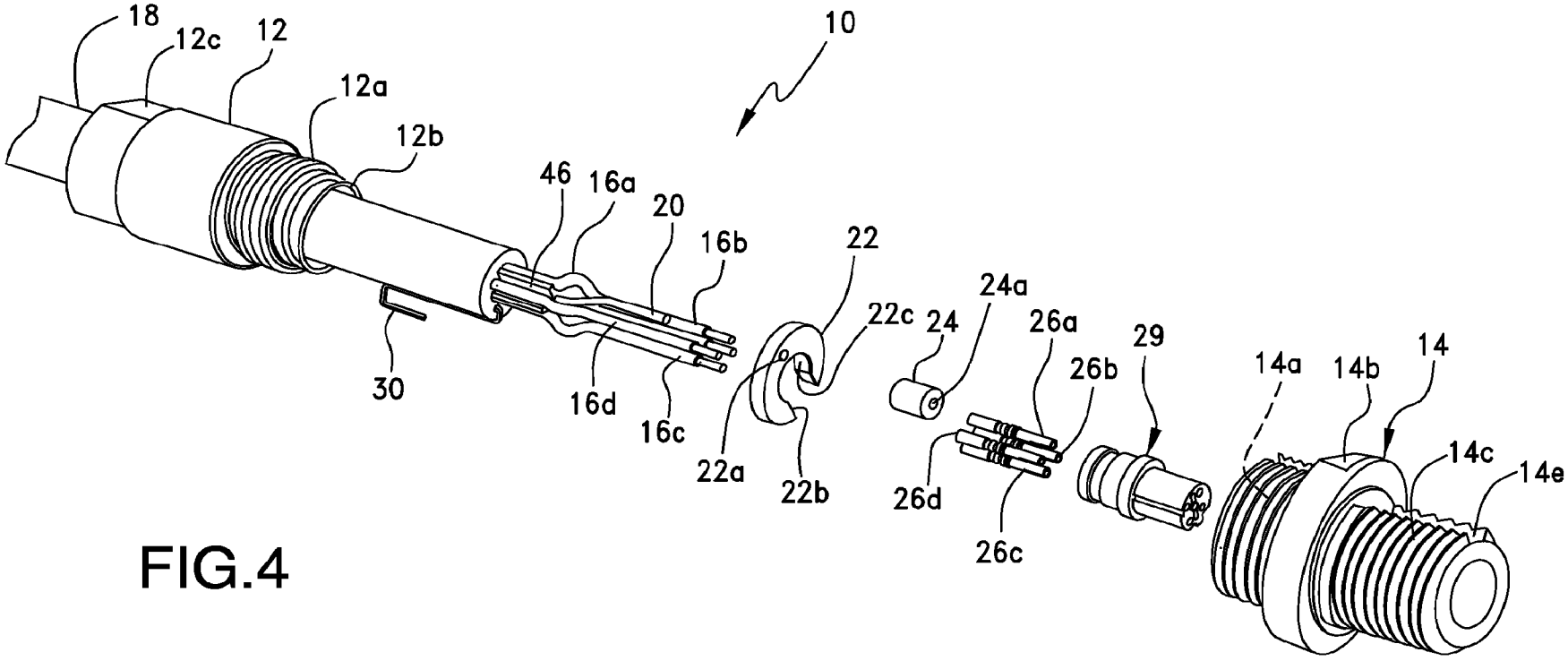
FIG. 4 is another exploded perspective view of the inventive harsh duty receptacle connector illustrating additional details of the invention.

Referring to FIG. 1, there is shown a side elevation view of a harsh duty receptacle connector 10 in accordance with the principles of the present invention. A longitudinal sectional view of the inventive receptacle connector 10 is shown in FIG. 2. FIGS. 3 and 4 are exploded perspective views illustrating additional details of the inventive receptacle connector 10.

Receptacle connector 10 includes a receptacle bushing 12 and a receptacle shell 14. Bushing 12 and shell 14 are generally cylindrical in shape, are preferably comprised of a high strength metal such as steel, and include respective center slots extending therethrough for receiving a shielded electrical cable 18.

Cable 18 includes plural spaced electrical conductors 16*a*-16*d* extending along the length thereof. Disposed within cable 18 and between the individual conductors 16*a*-16*d* is an elongated, nonconductive centering/isolating member 46 preferably comprised of a non-rigid plastic as shown in the sectional view of FIG. 6. Centering/isolating member 46 extends along the length of cable 18 and includes four spaced members 46*a*-46*d*. each extending radially outward from a center portion 46*e* of the center/isolating member. Each of the four radially extending spaced members 46*a*-46*d* is preferably integrally formed with the center portion 46*e* of the centering/isolating member 46. First spaced member 46*a* is disposed between first and second electrical conductors 16*a*. 16*b*. while second spaced member 46*b* is disposed between the second and third electrical conductors 16*b*. 16*c*. Similarly, the third spaced member 46*c* is disposed between the third and fourth electrical conductors 16*c*. 16*d* while the fourth spaced member 46*d* is disposed between the fourth and first electrical conductors 16*d*. 16*a*. Adjacent spaced members of centering/isolating member 46 maintain each electrical conductor in fixed position during electrical conductor 18 manufacture and provide electrical isolation between adjacent electrical conductors.

Figure 6:
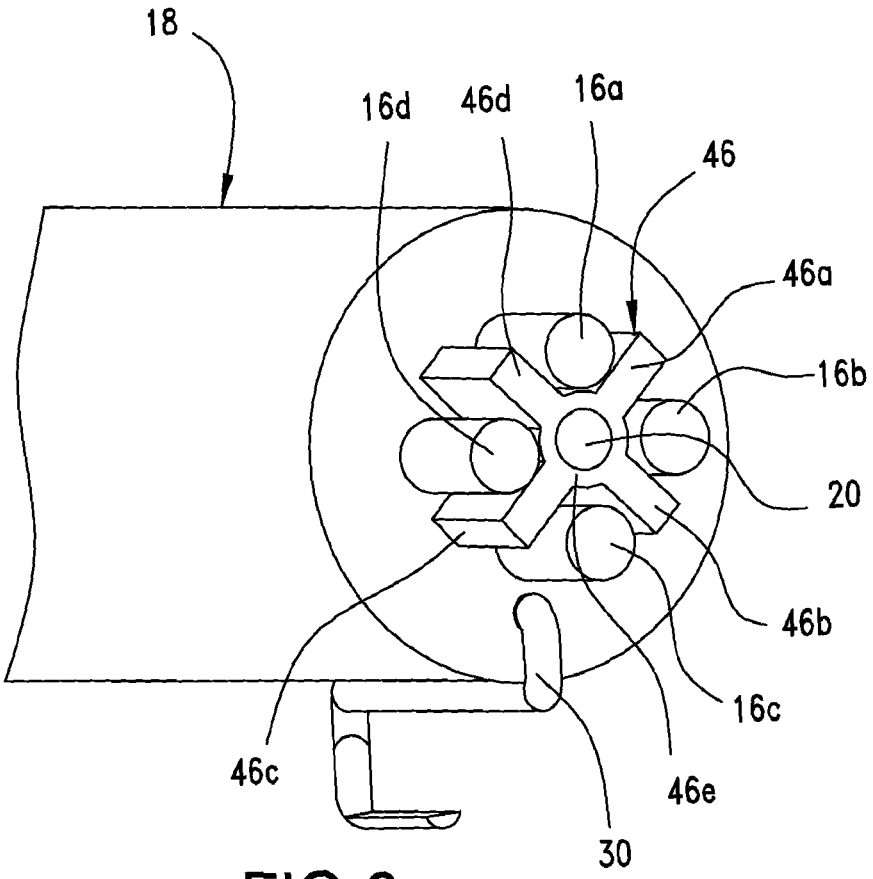
FIG. 6 is a sectional view of a multi-conductor cable with which the harsh duty receptacle connector of the present invention is adapted for use.

Extending along the length and disposed within the center portion 46*e* of the centering/isolating member 46 is a strength member 20, as also shown in FIG. 6. Strength member 20 could take on various forms, but in a preferred embodiment is a multi-strand steel aircraft cable which provides high strength for the harsh duty receptacle connector 10 as described in detail below. Centering/isolating member 46 also ensures that high strength member 20 is centered in cable 18 and provides physical isolation of the four conductors 46*a*-46*d* from strength members 20.

Figure 5:
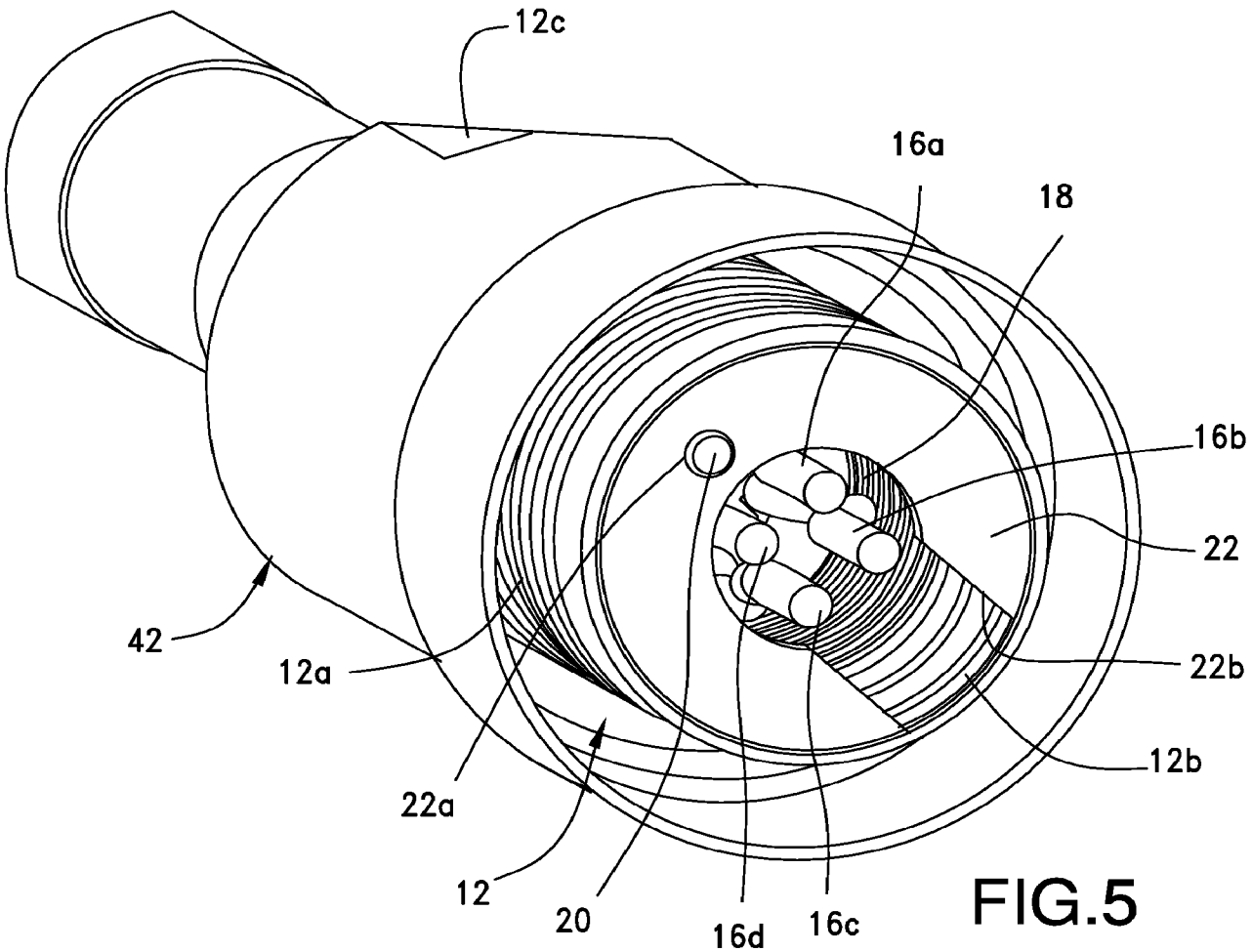
FIG. 5 is a sectional view illustrating internal details of the inventive harsh duty receptacle connector.

Receptacle bushing 12 includes an external threaded end portion 12*a* which is adapted for engagement with an internal threaded end portion 14*a* of receptacle shell 14. Receptacle shell 14 further includes a second outer threaded portion 14*c* and an intermediate enlarged shoulder portion 14*b* disposed between the receptacle shell's inner threaded portion 14*a* and its aforementioned outer threaded portion. The outer periphery of the receptacle shell's enlarged shoulder portion 14*b* is provided with plural flat portions 14*d* as shown in FIG. 1 to facilitate engagement of the receptacle shell 14 by a wrench (not shown) for attaching the receptacle shell to a nut 28 for securely mounting the inventive receptacle connector 10 to a structural member such as flat panel 27 as shown in FIG. 2. The outer threaded portion 14*c* of receptacle shell 14 is also provided with a keyway 14*e*, also as shown in FIG. 1, which is received by a matched portion in a cut-out (not shown) within the panel 27 to eliminate rotation of shell 14 during installation of nut 28. Finally, the outer peripheral surface of receptacle bushing 12 is also provided with plural spaced flat portions 12*c* as shown in FIGS. 3, 4 and 5 to facilitate manipulating the receptacle bushing by means of a tool such as a wrench.

Adjacent ends of each of the first through fourth conductors 16*a*-16*d* are adapted to receive respective electrical contacts 26*a*-26*d* as shown in FIG. 3. Each of the electrical contacts 26*a*-26*d* is adapted for insertion through a respective slot within a cylindrical insulator 29. Cylindrical insulator 29, which includes four slots 38 as shown in FIG. 3, is inserted into a circular slot extending through receptacle shell 14. An end 29*b* of the slotted cylindrical insulator 29 and the ends of the four electrical contacts 26*a*-26*d* extend outward from the end of receptacle shell 14. The four electrical contacts 26*a*-26*d* are adapted for mating electrical connection to respective electrical contacts of a complementary connector, which is not shown in the figures for simplicity. In addition, while the four electrical contacts 26*a*-26*d* are shown recessed within one of respective slots 38 in the slotted cylindrical insulator 29 for receiving complementary male contacts, the present invention also contemplates the use of the four electrical contacts in a male, or projecting, configuration for mating electrical engagement with four female contacts in the complementary electrical connector which is not shown in the figures for simplicity. Finally, an elongated slot 29*a* in a lateral portion of cylindrical insulator 29 forms a keyway for permitting mating contact of the distal end of the insulator and its associated four electrical contacts 26*a*-26*d* with a complementary configured connector.

Receptacle connector 10 further includes a drain wire attachment 30 attached to cable 18 and including a drain wire 30*a* which extends along the length of shielded cable 18. Drain wire attachment 30 is in electrical contact with receptacle bushing 12 which is maintained at ground potential because receptacle bushing is connected to receptacle shell 14 which is in contact with structural member 27 which is at ground potential. The combination of drain wire attachment 30 and its drain wire 30*a* maintains the cable's inner conductive sheath at the same potential along the entire length of cable 18 to provide effective electromagnetic interference (EMI) shielding for the cable. A first O-ring 34 is positioned between an inner portion of receptacle shell 14 and structural member 27 in a sealed manner. A small bead 44 of UV potting material is deposited on an outer peripheral surface of insulator 36 so as to form a seal with an inner surface of receptacle shell 14.

With the four conductors 16*a*-16*d* disposed within and along the length of cable 18 and maintained in fixed position therein by means of a centering/isolating member 46, the end of strength member 20, which is disposed within centering/isolating member, is inserted through a slot 22*a* within a split washer 22. A stop sleeve 24 comprised of a conductive material such as copper is crimped to the end of strength member 20 for securely attaching the stop sleeve to the strength member as shown in FIG. 3. There are various other approaches available for securely attaching a stop member to the end of the strength member 20 to prevent disconnection of the strength member from split washer 22, with the crimping arrangement shown in the figures being the preferred way to securely attach these two components of the receptacle connector 10 of the present invention.

With cable 18 disposed within and extending through receptacle bushing 12 and with the four conductors 16*a*-16*d* and the strength member 20 extending through an open inner portion 22*c* of split washer 22, the exterior threaded portion 12*a* of receptacle bushing 12 is positioned in contact with the internal threaded portion 14*a* of receptacle shell 14. Rotation of one or both of the receptacle bushing 12 and receptacle shell 14 relative to the other results in secure engagement between these two receptacle connector components. During tightening of the threaded engagement between the receptacle bushing 12 and receptacle shell 14, the outer peripheral portion of split washer 22 is positioned in contact with the end portion 12*b* of receptacle bushing 12 adjacent its exterior threaded portion 12*a* as shown in the sectional view of FIG. 5. Continued tightening of the threaded engagement between receptacle bushing 12 and receptacle shell 14 causes tension to be applied to strength member 20. When the receptacle connector 10 is tightly assembled and in use, this tension is maintained on strength member 20 which removes all tension from the four conductors 16*a*-16*d*. resulting in slack in all of these conductors. The slack in each of the first through fourth conductors 16*a*-16*d* is shown in FIGS. 2, 3 and 4 as bent portions of each of these conductors. This reduces the likelihood of detachment of any of the conductors from its associated end contact upon the application of a large axial force to the receptacle connector 10. In a preferred embodiment, strength member 20 is in the form of an aircraft cable capable of withstanding an axial tension of 300 pounds. Also in a preferred embodiment, the outer surface of receptacle bushing 12, and its juncture with cable 18, is covered with a thin layer of shrink tubing 42.

Once the inventive receptacle connector 10 is assembled, an inert semi-rigid potting compound having a high durameter rating is injected via a first slot 32 into the receptacle bushing 12. The potting compound, which is typically comprised of a polymer such as epoxy or polyurethane, encapsulates and fixes in position and configuration the electrical conductors 16*a*-16*d* therein. A second slot 33 within receptacle bushing 12 allows for the escape of air from the bushing as the potting compound is injected into the bushing.

While particular embodiments of the present invention have been described, it will be obvious to those skilled in the relevant arts that changes and modifications may be made without departing from the invention in its broader aspects. Therefore, the aim in the appended claims is to cover all such changes and modifications that fall within the true spirit and scope of the invention. The matters set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical receptacle connector adapted to receive an electrical cable having plural conductors, said electrical receptacle connector comprising:

a bushing adapted to receive the electrical cable and having a first threaded end portion;

a shell adapted to receive the electrical cable and having a second threaded end portion coupled to the first threaded end portion of said bushing;

an elongated, thin strength member disposed in and extending along a portion of the length of the electrical cable; and a split washer connected to said strength member and having an open inner portion and a partially circular peripheral portion, wherein said plural conductors are disposed in and extend through the open inner portion of said split washer and the partially circular peripheral portion of said split washer is disposed in contact with the first threaded end portion of said bushing, and wherein tightening of the coupling between said bushing's first threaded end portion and said shell's second threaded end portion urges said split washer into tight fitting engagement with said shell applying increased tension upon said strength member while removing tension from the plural conductors.

2. The electrical receptacle connector of claim 1, wherein said strength member is multi-strand steel cable.

3. The electrical receptacle connector of claim 2, further comprising a stop sleeve attached to said steel cable and engaging said split washer.

4. The electrical receptacle connector of claim 2, wherein a crimped stop sleeve is attached to said steel cable and engages said split washer.

5. The electrical receptacle connector of claim 3, wherein said stop sleeve is comprised of copper.

6. The electrical receptacle connector of claim 1, wherein said split washer includes a slot extending therethrough with said strength member disposed in tight fitting engagement with said slot for secure coupling to said split washer.

7. The electrical receptacle connector of claim 1, wherein said split washer is comprised of a high strength metal.

8. The electrical receptacle connector of claim 1, wherein said shell further includes a third threaded end portion disposed in opposed relation to said second threaded end portion and adapted to receive a coupling member for attaching the receptacle connector to a support structure.

9. The electrical receptacle connector of claim 8, wherein said coupling member is a coupling nut for attaching the receptacle connector to a support panel.

10. The electrical receptacle connector of claim 1, further comprising plural electrical contacts each connected to an end of a respective electrical conductor and an electrical insulator disposed within said shell and including plural spaced slots extending therethrough, wherein each of said spaced slots is adapted to receive a respective one of said electrical contacts.

11. The electrical receptacle connector of claim 10, wherein an outer end portion of said electrical insulator is adapted for coupling to a complementary multi-conductor electrical connector.

12. The electrical receptacle connector of claim 11, wherein the outer end portion of said electrical insulator includes a keyway for allowing the electrical receptacle connector to be coupled only to an electrical connector of complementary configuration.

13. The electrical receptacle connector of claim 12, wherein said keyway is in the form of a linear slot disposed on an outer lateral surface of said insulator.

14. The electrical receptacle connector of claim 1, further comprising an electrical insulating potting compound disposed within said bushing and encapsulating said conductors for electrically isolating said conductors from one another and maintaining said conductors in fixed position in said bushing.

15. The electrical receptacle connector of claim 14, wherein said bushing includes first and second slots disposed in and extending through said bushing for respectively allowing said potting compound to be deposited within said busing while allowing air to vent from said bushing during injection of the potting compound into said bushing.

16. The electrical receptacle connector of claim 1, further comprising shrink tubing disposed on an outer surface of said bushing and covering a juncture between said bushing and the electrical cable.

17. The electrical receptacle of claim 1, further comprising a centering/isolating member disposed within and extending along at least a portion of the length of the electrical cable, wherein said centering/isolating member encapsulates and centers the strength member within the electrical cable.

18. The electrical receptacle connector of claim 17, wherein said centering/isolating member includes a center portion encapsulating said strength member and plural spaced members extending radically outwardly from said center portion, wherein each spaced member is disposed intermediate adjacent electrical conductors.

19. The electrical receptacle connector of claim 17, wherein said centering/isolating member is comprised of a flexible plastic material.

20. A multi-conductor electrical cable and receptacle connector arrangement comprising:

a bushing adapted to receive the electrical cable and having a first threaded end portion;

a shell adapted to receive the electrical cable and having a second threaded end portion coupled to the first threaded end portion of said bushing;

an elongated, thin strength member disposed in and extending along a portion of the length of the electrical cable;

a retaining member having an open inner portion and a partially circular peripheral portion, wherein said plural conductors and said strength member were disposed in and extend through the open inner portion of said retaining member and the partially circular peripheral portion of said retaining member is disposed in contact with the first threaded end portion of said bushing for increasing the strength of the electrical cable receptacle and connector arrangement; and an elongated centering and isolating member disposed within and along at least a portion of the length of said cable, wherein said centering and isolating member is disposed about said strength member and intermediate adjacent conductors for centering said strength member within the cable and isolating the conductors from said strength member while maintaining the conductors in equally spaced relation from one another.

* * * * *